United States Patent [19]

Ericsson

[11] 4,318,568

[45] Mar. 9, 1982

[54] HINGE DEVICE FOR CONNECTING TWO FURNITURE PORTIONS

[75] Inventor: Ricky Ericsson, Älmhult, Sweden

[73] Assignee: Inter-Ikea A/S, Denmark

[21] Appl. No.: 136,482

[22] Filed: Apr. 2, 1980

[30] Foreign Application Priority Data

Apr. 9, 1979 [DK] Denmark ..... 1478/79

[51] Int. Cl.[3] ..... A47C 1/00

[52] U.S. Cl. ..... 297/354

[58] Field of Search ..... 297/354, 378, 1, 68, 297/301, 316, 325

[56] References Cited

U.S. PATENT DOCUMENTS 2,964,099 12/1960 Panicci ..... 297/354

3,900,225 8/1975 Wirtz et al. ..... 297/354

*Primary Examiner*—Patrick D. Lawson

[57] ABSTRACT

A hinge is made for connecting a sofa seat and a back which must be mutually pivotal. Each furniture portion has a circumferential frame of metal tube and has furthermore one or more tube projections (11) opposing corresponding projections (12) on the other furniture portion. Each tube projection (11) is provided with a bundle (21) of parallel sheet-shaped hinge means (121*a*, 121*b*) which by means of a main pin (23) are hinged to another almost corresponding bundle (22) of parallel sheet-shaped hinge means (122*a*, 122*b*) on the opposing tube projection (11) on the other furniture portion. Every second hinge means in each bundle (21) is constituted by a hinge lap (121*b*), and the other hinge means in the bundle are constituted by an angle controlling lap (121*a*).

Opposing hinge laps (121*b*, 122*b*) are inserted so much between each other that the main pin (23) can connect them, and the hinge lap (121*b*) and the angle controlling lap (121*a*) are placed in such a way that each hinge lap (121*b*) in one bundle (21) is always in register with an angle controlling lap (122*a*) in the other bundle (22). The hinge lap (FIG. 5) and the angle controlling lap (FIG. 6) have means (38*a*, 38*b*, 45) for restricting the angle of rotation (v) of one furniture portion relative to the other furniture portion.

The hinge allows a reliable limitation of the angular range within which the furniture portions may turn relative to each other.

7 Claims, 6 Drawing Figures

HINGE DEVICE FOR CONNECTING TWO FURNITURE PORTIONS

Figure 1:
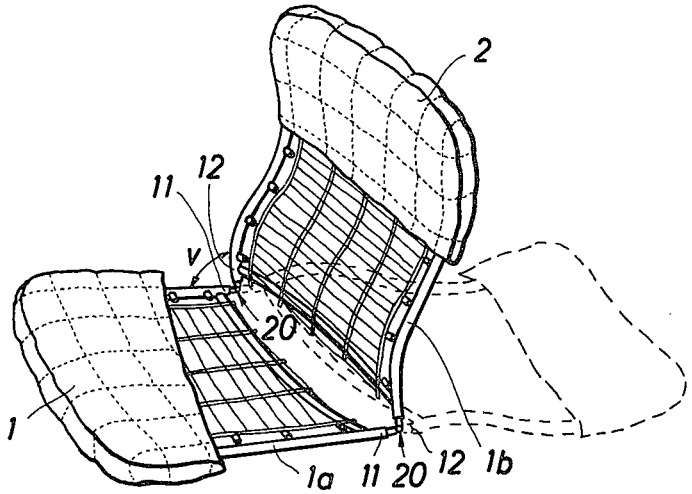

This invention relates to a hinge device for connecting two furniture portions such as a sofa seat and a back, which must be mutually pivotal, each furniture portion comprising a circumferential frame preferably of metal tubes, said furniture portion comprising one or more tube projections opposing corresponding projections on the second furniture portion.

Hinge means of this kind are known. They have all the disadvantage that they take up too much room, to which must be added that they are not adapted to allow turning of one furniture portion relative to the other furniture portion within a fixed angular range. It is the object of this invention to provide a hinge device of the kind mentioned above that remedies these disadvantages.

The hinge device according to the invention is characterized in that the individual tube projection on each furniture portion is provided with a bundle of parallel sheet-shaped hinge means which by means of a main pin is hinged to a second almost corresponding bundle of parallel sheet-shaped hinge means on the second tube projection of the second furniture portion opposing the tube projection, every second hinge means of each bundle being constituted by a hinge lap and the remaining hinge means of the bundle being constituted by an angle controlling lap, and that the hinge lap and the angle controlling lap are located in such a manner that each hinge lap of one bundle always opposes an angle controlling lap of the second bundle, the hinge lap and the angle controlling lap comprising means restricting the angle of rotation of one furture portion relative to the second furniture portion. As a result a very compact construction is obtained because the two hinge means bundles may be placed end to end, however projecting a little into each other. A further advantage is that the two furniture portions as a consequence of the means mentioned may only be turned relative to each other within a fixed angular range, e.g. between 80° and 180°. When it is important that the two furniture portions at least may be turned 180° relative to each other (i.e. in such a way that they will lie end to end) it is due to the requirement for a cheap transport of the furniture portions. When the two furniture portions form an angle of 180° with each other many pairs of such furniture portions may easily be piled without forming large cavities.

According to the invention each hinge lap may be constituted by an anchoring portion and a main portion, the main pin extending through the main portion, the main portion comprising means restricting the angle of rotation, said means being constituted by two angle limitation stops, on which the angle controlling lap may abut.

Furthermore, each angle controlling lap may according to the invention be constituted by an anchoring portion and a guide portion, the latter comprising an angle restricting means in the form of a guide knob, which may abut on the two angle limitation stops of the main portion. Thus a particularly reliable hinge device is obtained.

According to the invention the hinge laps and the angle controlling laps of each bundle may be riveted by means of at least two transverse rivets, so that each bundle forms a rigid unit, at least one rivet extending through said main portions and guide portions of said bundle. Thus the individual bundle will be sufficiently rigid.

Furthermore, the hinge laps and the angle controlling laps of each hinge means bundle may be mounted on the associated tube projection by the anchoring portions of the hinge laps and the angle controlling laps being inserted in the tube projection and secured thereto, e.g. by riveting. Thereby a very reliable fastening of each individual hinge means bundle to the tube projection in question is ensured.

Furthermore, according to the invention some of the anchoring portions of the hinge laps and the angle controlling laps may be bevelled on their longitudinal rims, whereby is obtained that there will be room for at least an extra hinge lap and an extra angle controlling lap in each individual hinge means bundle (the latter being inserted in the tube projection mentioned), whereby the hinge device will be stronger.

Finally, the two angle limitation stops of the main portion may according to the invention be at least 100° angularly displaced, preferably in such a manner that the angle of one hinge means bundle relative to the second hinge means bundle may be set between 80° and 180°. This angular range has in practice proved to be particularly suitable when two furniture portions are a seat and a back, respectively, for a sofa or an armchair, and said portions have to be transported at a very low price.

Figure 2:
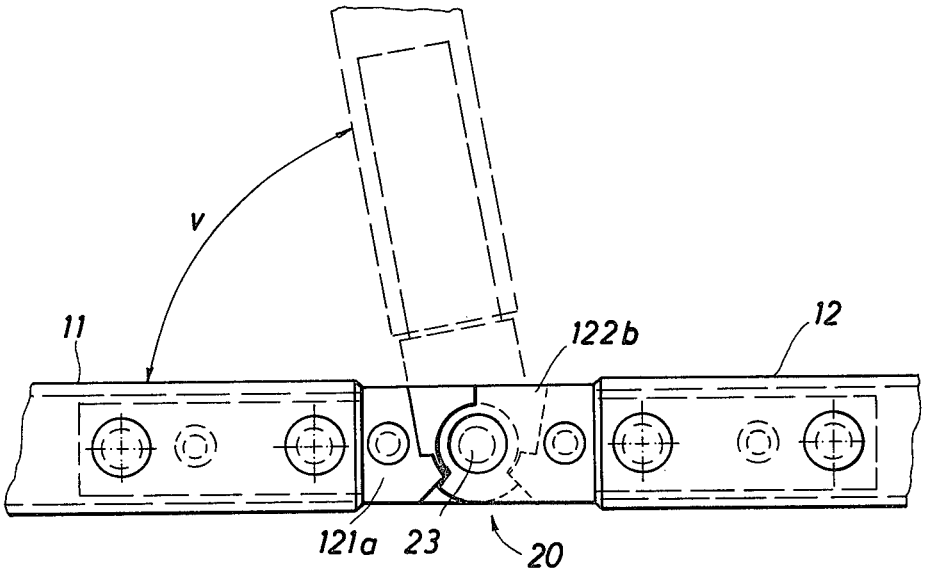
Figure 3:
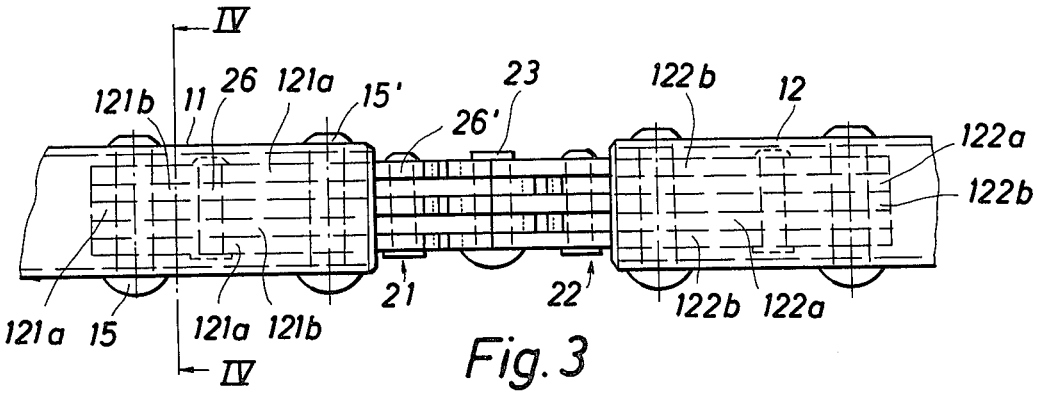
Figure 4:
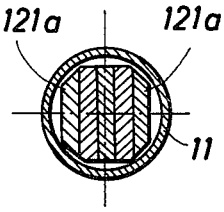
Figure 5:
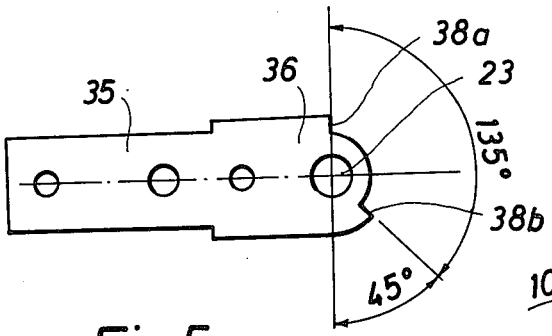
Figure 6:
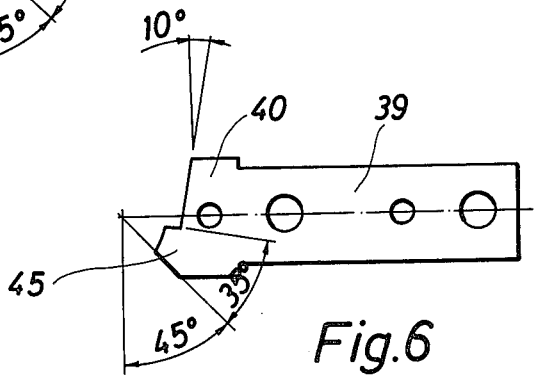

The invention will be explained below with reference to the accompanying drawing, in which FIG. 1 is a perspective view of the hinge device according to the invention used for connecting a seat and a back of an armchair, two hinge devices being provided, FIG. 2 is an end view of a hinge device according to the invention, two hinge means bundles being turned relative to each other so that they form an angle of 180°, FIG. 3 is a top plan view of the hinge device of FIG. 2, FIG. 4 is a sectional view through the device taken along the line IV—IV in FIG. 3, FIG. 5 is an end view of a hinge lap, and FIG. 6 is an end view of an angle controlling lap.

In FIG. 1 are shown two furniture portions in the form of a seat portion 1 and a back portion 2 of an armchair. Each furniture portion has a circumferential frame, 1*a* and 1*b*, respectively. Two tube projections 11 extend from the frame 1*a*, and two tube projections 12 extend from the frame 1*b*. As shown, the projections 11 and 12 are positioned on the same level and hinged together by means of a hinge device 20 according to the invention.

In FIG. 2 these tube projections 11 and 12 are seen clearly, and in FIG. 3 is seen how the hinge device according to the invention is made of two bundles, 21 and 22, respectively, of parallel sheet-shaped hinge means hinged to each other by means of a main plug 23. The bundle 21 is built as follows: First there is an angle controlling lap 121*a* corresponding to the one shown in FIG. 5; next behind the lap 121*a* there is a hinge lap 121*b* corresponding to the one shown in FIG. 6 but laterally reversed. Then follows again an angle controlling lap 121*a* as in FIG. 5 etc. The hinge means bundle 22 is built as follows: First there is a hinge lap 122*b* corresponding to the one shown in FIG. 5 but laterally reversed. Behind the lap 122*b* follows an angle controlling lap 122*a* corresponding to the one shown in FIG. 6. Then follows again a hinge lap 122*b* corresponding to the one shown in FIG. 5 etc. As will be seen, each hinge lap in one bundle 21 always register with an angle controlling lap in the other bundle 22.

As will appear from FIGS. 5 and 6, each individual hinge lap and each individual angle controlling lap have means for restricting the angle of rotation v of the furniture portions 1 and 2 relative to each other. This will be explained in more detail below.

As shown in FIG. 5, each hinge lap is constituted by an anchoring portion 35 and a main portion 36, the main pin 23 extending through a hole in the latter. The main portion is further provided with two means restricting the angle of rotation, said means being two angle limitation stops 38*a* and 38*b* on which a guide knob on the angle controlling lap may abut, (said guide knob representing a means restricting the angle of rotation).

In FIG. 3 is shown how the hinge laps and the angle controlling laps in the bundle 21 are riveted by means of two transverse rivets 26 and 26'. However, more than two rivets may be used. As will be seen, the rivet 26' is led through the main portions of the hinge laps 121*b* and also through the control portions 121*a* of the angle controlling laps. The same counts for the hinge laps and angle controlling laps in the bundle 22. By riveting the hinge laps and the angle controlling laps in each bundle, e.g. the bundle 21, the bundle will be very stable. Consequently, it may easily be fastened in the tube projection 11 by inserting the anchoring portions of the bundle in said tube projection and riveting the anchoring portions there by means of at least two rivets 15 and 15'.

As shown in FIG. 4, the foremost and rearmost of the angle controlling laps 121*a* in the bundle 21 may have their anchoring portions bevelled, so that the number of hinge laps and angle controlling laps in the bundle may be made suitably large even if there is not much room in the tube projection. As shown, the bundle 21 fills up the tube projection quite well.

When the angle limitation stops 38*a* and 38*b* in FIG. 5 have the angle positions shown, and the guide knob 45 in FIG. 6 has the angle position shown in FIG. 6 the furniture portions 1 and 2 can be turned so that they form an angle v with each other, said angle being in the range between 80° and 180°, cf. FIG. 2.

The hinge laps and the angle controlling laps may suitably be of 3 mm steel plate when the hinge devices are to be used for armchairs and sofas. The tube projections 11 and 12 may then have an outer diameter of 22 mm and an internal diameter of 19 mm.

The hinge device according to the invention is fit not only for indoor furniture. It may also be used for garden furniture.

When a user has bent the furniture portions 1 and 2, see FIG. 1, to the desired angle v, preferably between 80° and 180°, the furniture portions 1 and 2 are locked relative to each other by means of per se known locking portions (not shown).

It is possible to alter the invention in many ways without deviating from the inventive idea.

I claim:

1. A hinge device for connecting two furniture portions (1, 2) such as a sofa seat (1) and a back (2), which must be mutually pivotal, each furniture portion comprising a circumferential frame (1*a*, 1*b*) preferably of metal tubes, said furniture portion comprising one or more tube projections (11) opposing corresponding projections (12) on the second furniture portion, characterized in that the individual tube projection (11) on each furniture portion (1) is provided with a bundle (21) of parallel sheet-shaped hinge means (121*a*, 121*b*), which by means of a main pin (23) is hinged to a second almost corresponding bundle (22) of parallel sheet-shaped hinge means (122*a*, 122*b*) on the second tube projection (12) of the second furniture portion (2) opposing the tube projection (11), every second hinge means of each bundle (21) being constituted by a hinge lap (121*b*) and the remaining hinge means of the bundle being constituted by an angle controlling lap (121*a*), and that the hinge lap (121*b*) and the angle controlling lap (121*a*) are located in such a manner that each hinge lap (121*b*) of one bundle (21) always opposes an angle controlling lap (122*a*) of the second bundle (22), the hinge lap (121*b*) and the angle controlling lap (122*a*) comprising means (38*a*, 38*b*, 45) restricting the angle of rotation (v) of one furniture portion (1) relative to the second furniture portion (2).

2. A hinge device as claimed in claim 1, characterized in that each hinge lap (121*b*, 122*b*) is constituted by an anchoring portion (35) and a main portion (36), the main pin (23) extending through the main portion, the main portion (36) comprising means restricting the angle of rotation, said means being constituted by two angle limitation stops (38*a*,38*b*), on which the angle controlling lap (121*a*, 122*a*) may abut.

3. A hinge device as claimed in claims 1 or 2, characterized in that each angle controlling lap (121*a*, 122*a*) is constituted by an anchoring portion (39) and a guide portion (40), the latter comprising an angle restricting means in the form of a guide knob (45), which may abut on the two angle limitation stops (38*a*, 38*b*) of the main portion (36).

4. A hinge device as claimed in claim 1, characterized in that the hinge laps (121*b*) and the angle controlling laps (121*a*) of each bundle (21) are riveted by means of at least two transverse rivets (26, 26') so that each bundle (21) forms a rigid unit, and that at least one rivet (26') extends through said main portions (36) and guide portions (40) of said bundle.

5. A hinge device as claimed in claim 1, characterized in that the hinge laps (121*b*) and angle controlling laps (121*a*) of each hinge means bundle (21) are mounted on the associated tube projection (11) by the anchoring portions (38, 39) of the hinge laps (121*b*) and the angle controlling laps (121*a*) being inserted in the tube projection (11) and secured thereto, e.g. by riveting (15, 15').

6. A hinge device as claimed in claim 5, characterized in that some of the anchoring portions (38, 39) of the hinge laps (122*b*) and the angle controlling laps (121*a*) are bevelled on their longitudinal rims.

7. A hinge device as claimed in claim 1, characterized in that the two angle limitation stops (38*a*, 38*b*) of the main portion (36) are at least 100° angularly displaced and preferably so that the angle (v) of one hinge means bundle (21) relative to the second hinge means bundle (22) may be set between 80° and 180°.

* * * * *